US011242750B2

(12) United States Patent
Stankus et al.

(10) Patent No.: US 11,242,750 B2
(45) Date of Patent: Feb. 8, 2022

(54) ADJUSTABLE LATTICE GIRDER

(71) Applicant: FCI Holdings Delaware, Inc., Wilmington, DE (US)

(72) Inventors: John C. Stankus, Canonsburg, PA (US); Dakota Faulkner, Wexford, PA (US); Jacob Hunter, Matthews, NC (US); John J. Breedlove, Cedar Bluff, VA (US); James Edward Pinkley, Aurora, CO (US)

(73) Assignee: FCI Holdings Delaware, Inc., Wilmington, DE (US)

( * ) Notice: Subject to any disclaimer, the term of this patent is extended or adjusted under 35 U.S.C. 154(b) by 0 days.

(21) Appl. No.: 17/101,444

(22) Filed: Nov. 23, 2020

(65) Prior Publication Data

US 2021/0156251 A1 May 27, 2021

Related U.S. Application Data

(60) Provisional application No. 62/939,857, filed on Nov. 25, 2019.

(51) Int. Cl.

| | |
|---|---|
| ***E21D 11/22*** | (2006.01) |
| ***E21D 15/52*** | (2006.01) |
| ***E21D 15/502*** | (2006.01) |
| ***E21D 11/20*** | (2006.01) |

(52) U.S. Cl.

CPC ..... *E21D 11/22* (2013.01); *E21D 11/20* (2013.01); *E21D 15/502* (2013.01); *E21D 15/52* (2013.01)

(58) Field of Classification Search

CPC ..... E21D 11/22; E21D 11/10; E21D 11/20; E04G 11/56

See application file for complete search history.

(56) References Cited

U.S. PATENT DOCUMENTS 3,462,959 A * 8/1969 Mallander ..... E21D 11/22 405/153
4,112,694 A 9/1978 Gruber
4,776,729 A 10/1988 Seegmiller (Continued)

FOREIGN PATENT DOCUMENTS

CH 646491 A5 11/1984
CN 102182483 A 9/2011

(Continued)

*Primary Examiner* — Sunil Singh
(74) *Attorney, Agent, or Firm* — The Webb Law Firm

(57) ABSTRACT

An adjustable lattice girder includes a first lattice girder portion having a first end and a second end positioned opposite the first end, with the first lattice girder portion having a first connection member, and a second lattice girder portion having a first end and a second end positioned opposite the first end, with the second lattice girder portion having a second connection member configured to engage the first connection member. The first connection member is slidable relative to the second connection member between a first position corresponding to a first distance between the second end of the first lattice girder portion and the first end of the second lattice girder portion, and a second position corresponding to a second distance between the second end of the first lattice girder portion and the first end of the second lattice girder portion. The first distance different than the second distance.

10 Claims, 12 Drawing Sheets

(56) References Cited

U.S. PATENT DOCUMENTS

| | | | |
|---|---|---|---|
| 5,193,940 | A | 3/1993 | Long |
| 6,796,334 | B2 | 9/2004 | Ishikawa et al. |
| 6,921,232 | B2 | 7/2005 | Domanski et al. |
| 9,528,273 | B1 | 12/2016 | Harkins |

FOREIGN PATENT DOCUMENTS

| | | | | |
|---|---|---|---|---|
| CN | 102518459 | B | | 4/2014 |
| CN | 107514062 | A | | 12/2017 |
| DE | 2602209 | A1 | * | 9/1977 |
| DE | 3017428 | A1 | * | 11/1981 |
| DE | 3232269 | A1 | | 3/1984 |
| DE | 8709411 | U1 | | 8/1987 |
| DE | 19922094 | A1 | * | 11/2000 |
| DE | 102012108471 | B3 | | 9/2013 |
| GB | 2299112 | A | | 9/1996 |
| GB | 2287729 | B | | 7/1997 |
| KR | 101257106 | B1 | | 4/2013 |

* cited by examiner

ADJUSTABLE LATTICE GIRDER

CROSS-REFERENCE TO RELATED APPLICATION

This application claims the benefit of U.S. Provisional Patent Application No. 62/939,857, filed Nov. 25, 2019, which is hereby incorporated by reference in its entirety.

BACKGROUND OF THE INVENTION

Field of the Invention

The present invention relates to an adjustable lattice girder and, more specifically, to an adjustable connection for a lattice girder.

Description of Related Art

To deal with supporting excavations, the civil tunneling industry has moved away from traditional supports using heavy rolled steel arches, to lighter and more manageable lattice girders. Lattice girders provide excavators and engineers with greater options in design, increased flexibility, and a more cost effective method of construction when excavating lengths of tunnels. Lattice girders are installed along the sides and the roof of an excavation or tunnel in order to provide support to the surrounding walls during construction.

Lattice girders are premanufactured with profiles and stationary joints that cannot be easily modified once installed. This presents a challenge as excavated profiles and underground travel ways are highly variable and have the potential for shifting during construction. Due to the presence of the highly variable and random nature of excavating profiles, which typically cannot be consistently supported by lattice girders, conventional solutions for modifying lattice girders are unsuitable.

SUMMARY OF THE INVENTION

According to one aspect or embodiment, an adjustable lattice girder includes a first lattice girder portion having a first end and a second end positioned opposite the first end, with the first lattice girder portion having a first connection member, and a second lattice girder portion having a first end and a second end positioned opposite the first end, with the second lattice girder portion having a second connection member configured to engage the first connection member. The first connection member is slidable relative to the second connection member between a first position corresponding to a first distance between the second end of the first lattice girder portion and the first end of the second lattice girder portion, and a second position corresponding to a second distance between the second end of the first lattice girder portion and the first end of the second lattice girder portion. The first distance is different than the second distance.

The first connection member may define a first profile and the second connection member may define a second profile, with one of the first and second profiles configured to engage and slide along the other of the first and second profiles. The first and second profiles may be V-shaped. The first and second connection members may each include a first flange, a first side portion extending from the first flange, a bottom portion extending from the first side portion, a second side portion extending from the bottom portion, and a second flange extending from the second side portion.

The adjustable lattice girder may further include a lock mechanism configured to lock the first and second connection members in one of the first and second positions. The lock mechanism may be a clamp. The clamp may include a first clamp member and a second clamp member, with the clamp configured to receive an overlapping portion of the first and second connection members between the first clamp member and the second clamp member.

The first and second connection member may each include a base and an extension portion extending from the base.

The first connection member may define an opening configured to receive at least a portion of the extension portion of the second connection member. The second connection member may define an opening configured to receive at least a portion of the extension portion of the first connection member. The bases of the first and second connection members may be spaced from each other when the first and second connection members are in the first position, with the bases of the first and second connection members engaged with each other when the first and second connection members are in the second position.

In a further aspect or embodiment, a lattice girder system includes a plurality of adjustable lattice girders, with each adjustable lattice girder including: a first lattice girder portion having a first end and a second end positioned opposite the first end, the first lattice girder portion having a first connection member; and a second lattice girder portion including a first end and a second end positioned opposite the first end, the second lattice girder portion having a second connection member configured to engage the first connection member, with the first connection member slidable relative to the second connection member between a first position corresponding to a first distance between the second end of the first lattice girder portion and the first end of the second lattice girder portion, and a second position corresponding to a second distance between the second end of the first lattice girder portion and the first end of the second lattice girder portion. The first distance is different than the second distance.

The lattice girder system may be arch shaped. The lattice girder system may be configured to support an excavation. The first connection member of at least one of the adjustable lattice girders may include a first profile and the second connection member may include a second profile, where one of the first and second profiles is configured to engage and slide along the other of the first and second profiles.

DETAILED DESCRIPTION OF THE INVENTION

Figure 1:
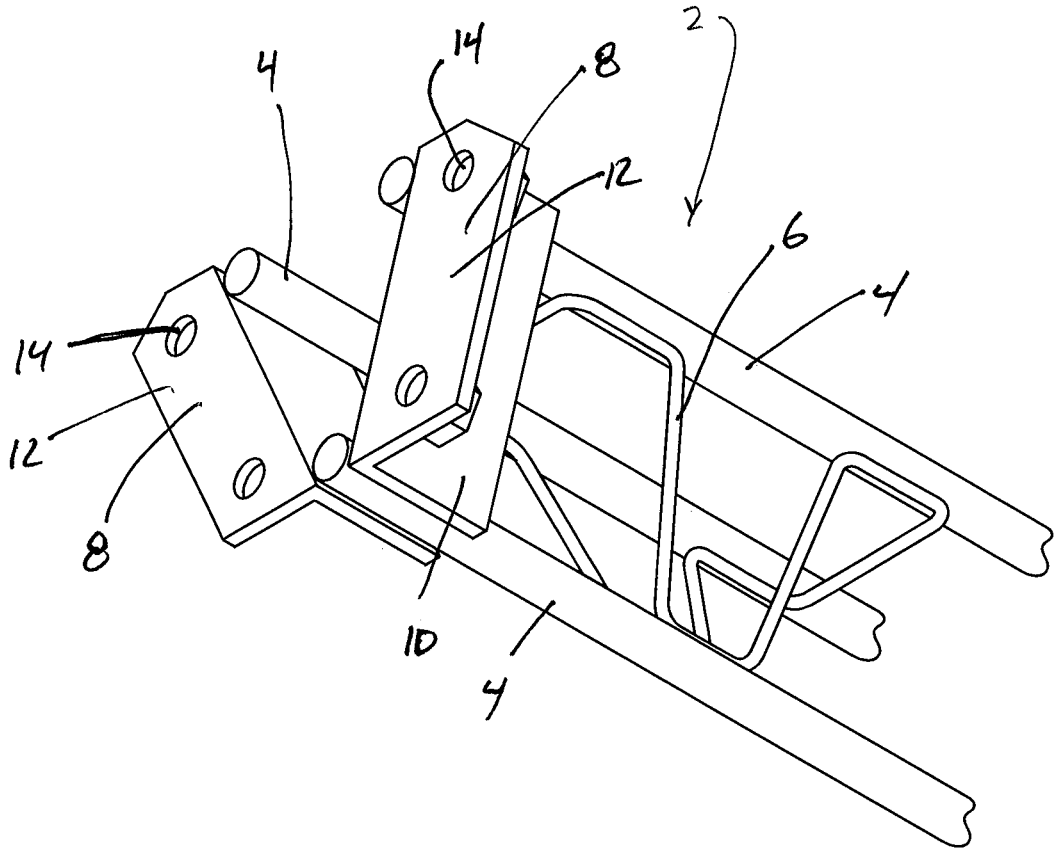
FIG. 1 is a partial perspective view of a lattice girder portion according to one aspect of the present invention.

The following description is provided to enable those skilled in the art to make and use the described aspects contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

For purposes of the description hereinafter, the terms "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary aspects of the invention. Hence, specific dimensions and other physical characteristics related to the aspects disclosed herein are not to be considered as limiting.

Figure 12:
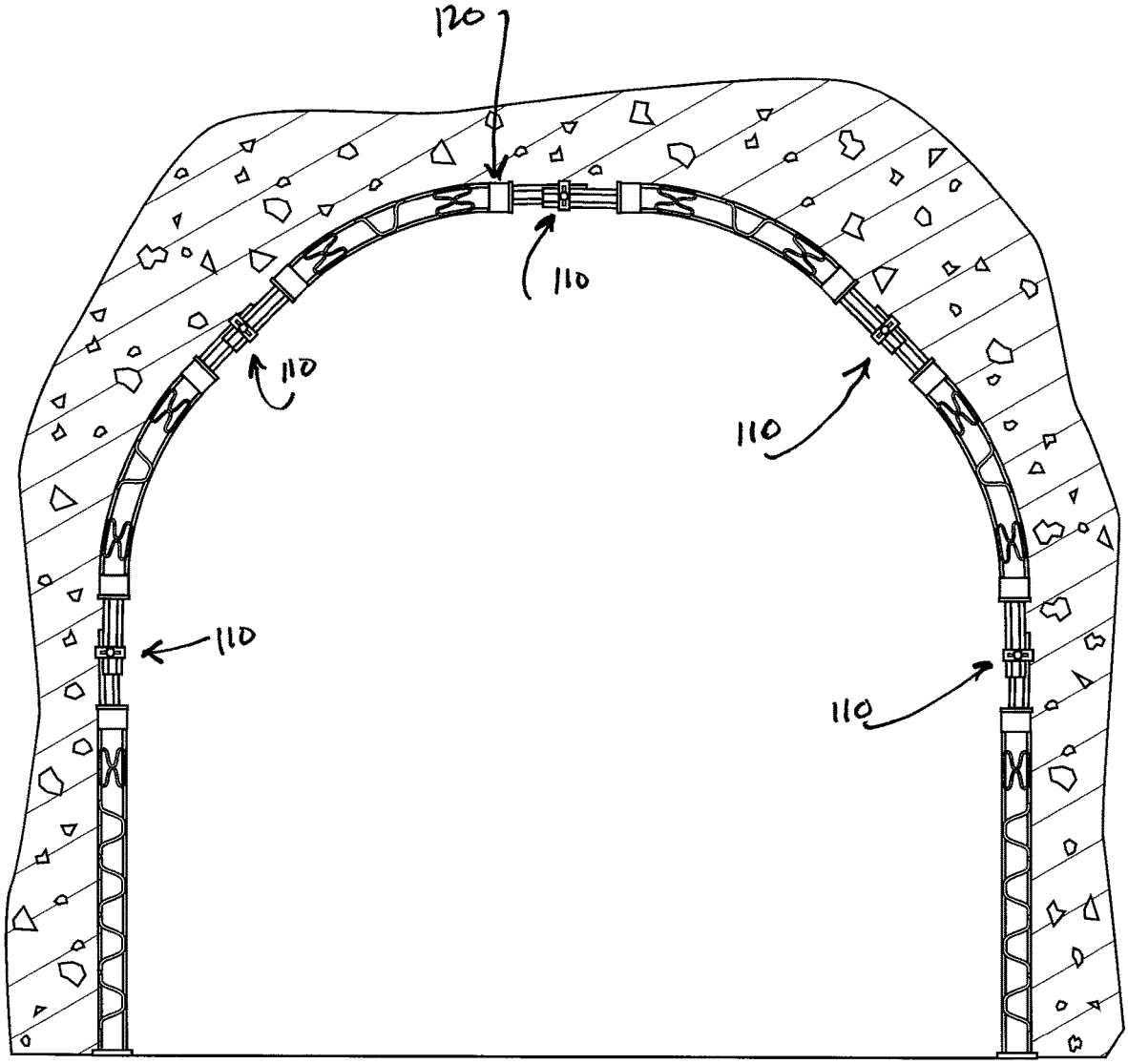
FIG. 12 a side view of the adjustable lattice girder of FIG. 8, showing the adjustable lattice girder applied to an excavation wall.

Referring to FIG. 1, a lattice girder portion 2 according to one aspect or embodiment of the present disclosure is shown. The lattice girder portion 2 has multiple rods of rebar 4 extending along its length with connecting rods 6 extending between each rod of rebar 4. The connecting rods 6 may take any configuration between the rebar 4 so as to increase the support strength of the lattice girder portion 2 when applied to an excavation as shown in FIG. 12. The connecting rods 6 are welded to the rebar 4, although other suitable connection arrangements may be utilized. The rebar 4 may be straight, curved, or otherwise shaped so as to support the tunnel wall. The rebar 4 is connected to an end plate 8. The end plate 8 has a first portion 10 and a second portion 12. The first portion 10 is connected to the rebar 4 and the second portion 12 is generally perpendicular to the first portion 10. The second portion 12 may form any angle with the first portion 10 in order to accommodate different adjustment mechanisms. The rebar 4 may be connected to the connecting rods 6 and the end plate 8 by methods known to a person of ordinary skill in the art, such as welding, or the rebar 4, connecting rods 6, and end plate 8 may be formed together as one piece. The lattice girder portion 2 may include two, spaced-apart end plates 8, with each end plate 8 having the first portion 10 and second 12 portions.

The second portion 12 of the end plates 8 defines a plurality of apertures 14 for connecting multiple lattice girder portions 2. While four apertures 14 are shown in FIG. 1, any number of apertures 14 may be used to facilitate the fastening and connection between multiple lattice girder portions 2. Attachment mechanisms that do not require apertures 14 may also be utilized.

Figure 2:
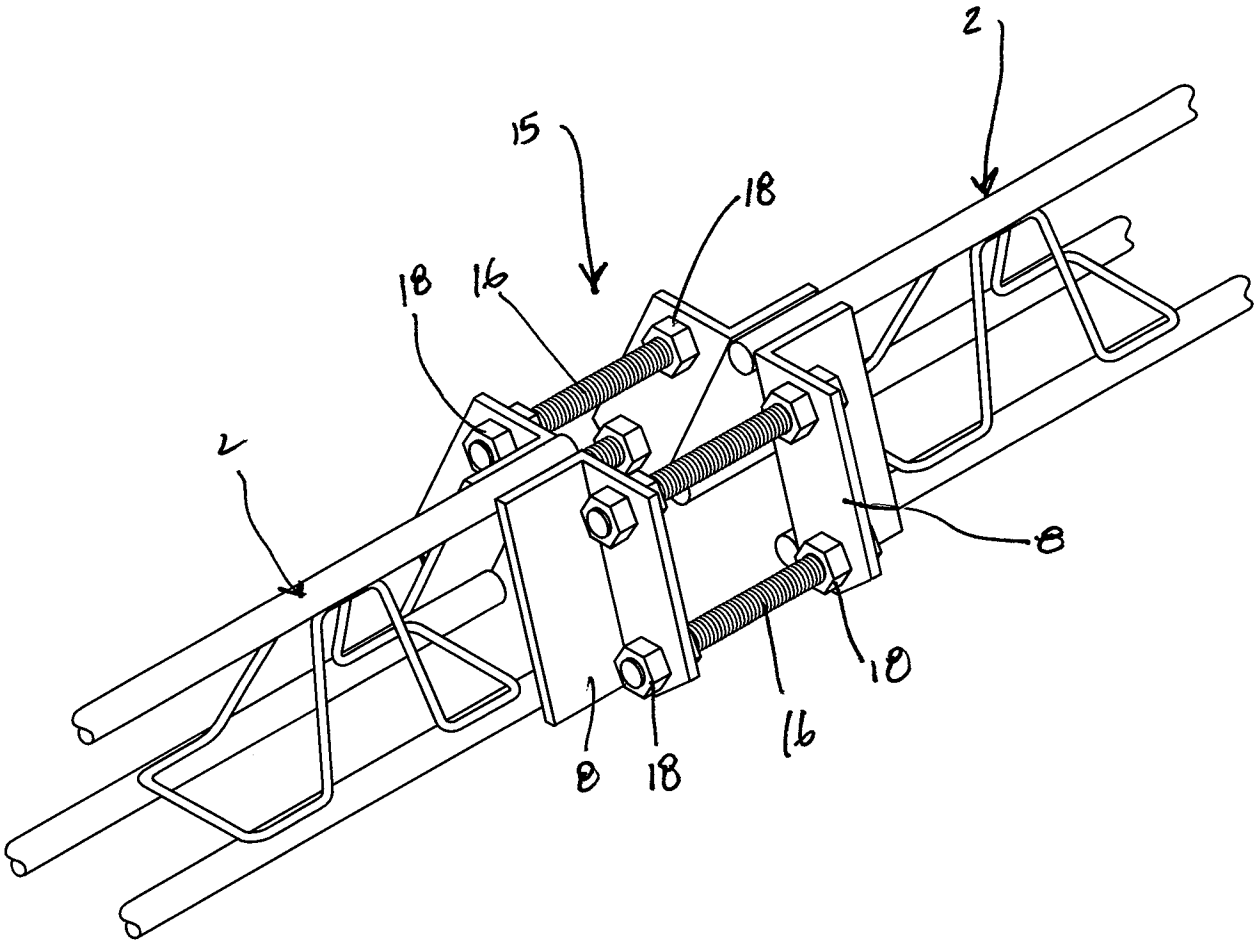
FIG. 2 is a partial perspective view of an adjustable lattice girder according to one aspect of the present invention.

Referring to FIG. 2, an adjustable lattice girder 15 according to one aspect or embodiment of the present application includes a threaded bolt 16 and nut 18 connection to connect two lattice girder portions 2. The bolt 16 may be entirely threaded thus permitting a length between lattice girder portions 2 to be adjusted in accordance with a length of the bolt 16, which is positioned through the apertures 14 of the opposing end plates 8 and secured utilizing the nuts 18. Although a threaded bolt 16 and nut 18 connection is shown, other suitable connection or fastening methods known to a person having ordinary skill in the art may be used.

Figure 3:
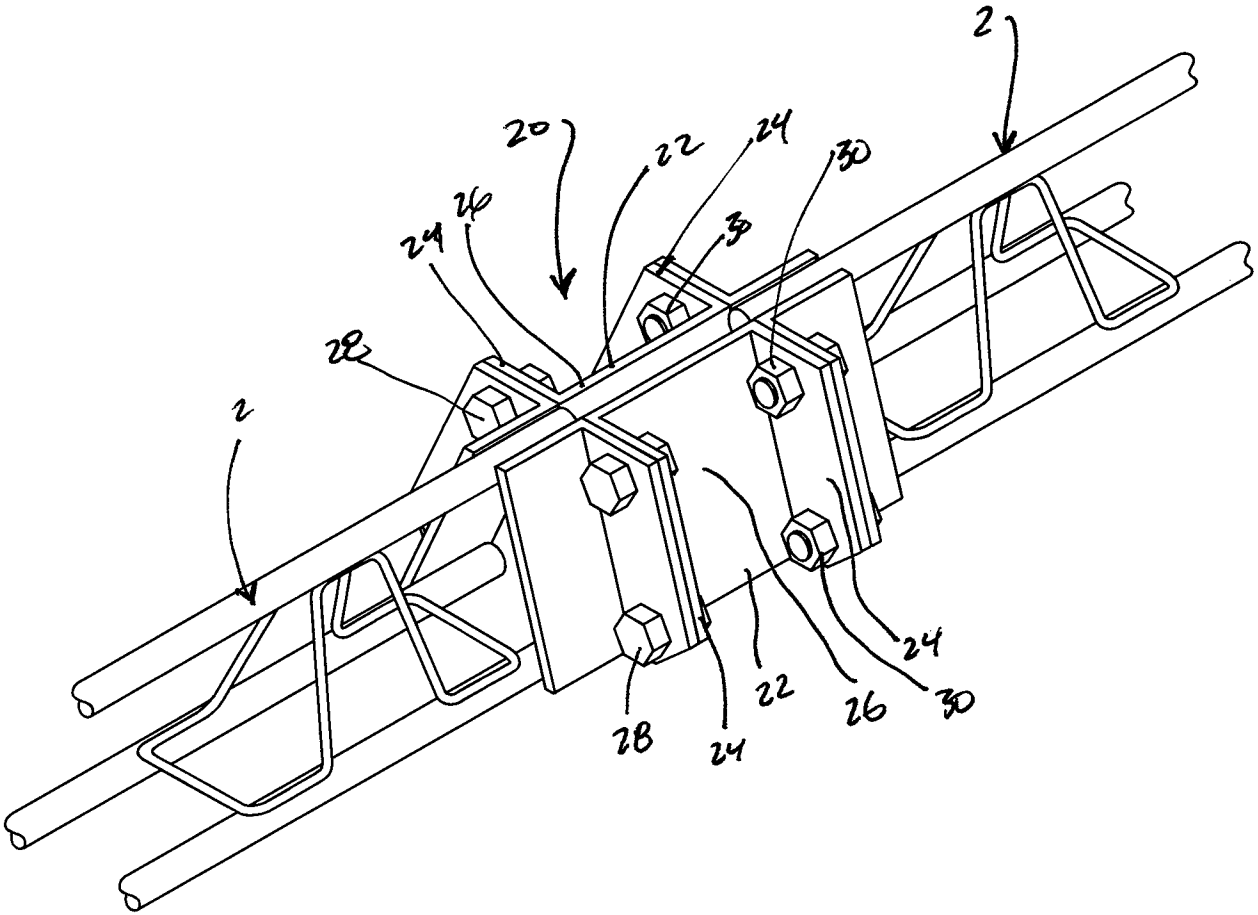
FIG. 3 is a partial perspective view of an adjustable lattice girder according to a second aspect of the present invention.

Referring now to FIG. 3, an adjustable lattice girder 20 according to a second aspect or embodiment includes spacers 22, which are used to connect the two, spaced-apart end plates 8 of the lattice girder portions 2. The spacers 22 have two end portions 24 and a spacing portion 26 between the end portions 24. The end portions 24 are configured to abut the second portions 12 of the respective end plates 8. The end portions 24 define apertures (not numbered) that correspond to the positioning of the apertures 14 on the second portion 12 of each end plate 8. Bolts 28 and nuts 30 are used to fasten the end portions 24 to the second portion 12 so that the spacers 22 are connected to and extend between the lattice girder portions 2. Although the bolts 28 and nuts 30 are utilized, other fastening mechanisms known to a person having ordinary skill in the art may also be used. The spacing portion 26 extends between the end portions 24 and separates the two lattice girder portions 2. The spacing portion 26 can have a variety of lengths depending on the desired distance between two lattice girder portions 2. The excavations may require a lattice girder system with different dimensions and/or geometry to accommodate variations of the excavation surface. In those instances, a spacer 22 having a shorter spacing portion 26 may be unfastened and replaced with a spacer 22 having a longer spacing portion 26, thus providing the lattice girder system with the necessary size and geometry to support the excavation.

Referring to FIGS. 4-7, an adjustable lattice girder 40 according to a third aspect or embodiment includes a first lattice girder portion 42 having a first connection member 44 and a second lattice girder portion 46 having a second connection member 48. The first lattice girder portion 42 includes a first end 52 and a second end 54 positioned opposite the first end 52. The second lattice girder portion 46 includes a first end 56 and a second end 58 positioned opposite the first end 56. The first connection member 44 is slidable relative to the second connection member 48 between a first position corresponding to a first distance between the second end 54 of the first lattice girder portion 42 and the first end 56 of the second lattice girder portion 46, and a second position corresponding to a second distance between the second end 54 of the first lattice girder portion 42 and the first end 56 of the second lattice girder portion 46. The first distance is different than the second distance. The first and second connection members 44, 48 are utilized to connect the first and second lattice girder portions 42, 46 to each other while allowing the distance between the first and second lattice girder portions 42, 46 to be adjusted to accommodate variations in the dimensions and geometry of the excavation surface that the first and second lattice girder portions 42, 46 are utilized to support.

Referring again to FIGS. 4-7, the first connection member 44 defines a first profile and the second connection member 48 defines a second profile, with the first profile configured to engage and slide along the other of the first and second profiles. In one aspect, a top surface 60 of the second connection member 48 is shaped and configured to receive and engage a bottom surface 62 of the first connection member 44. The first and second profiles are V-shaped, although other suitable shapes and configurations may be utilized. The first and second connection members 44, 48 each include a first flange 64, 66, a first side portion 68, 70 extending from the first flange 64, 66, a bottom portion 72, 74 extending from the first side portion 68, 70, a second side portion 76, 78 extending from the bottom portion 72, 74, and a second flange 80, 82 extending from the second side portion 76, 78. The first and second connection members 44, 48 each include a base 84, 86 and an extension portion 88, 90 extending from the base 84, 86.

Figure 4:
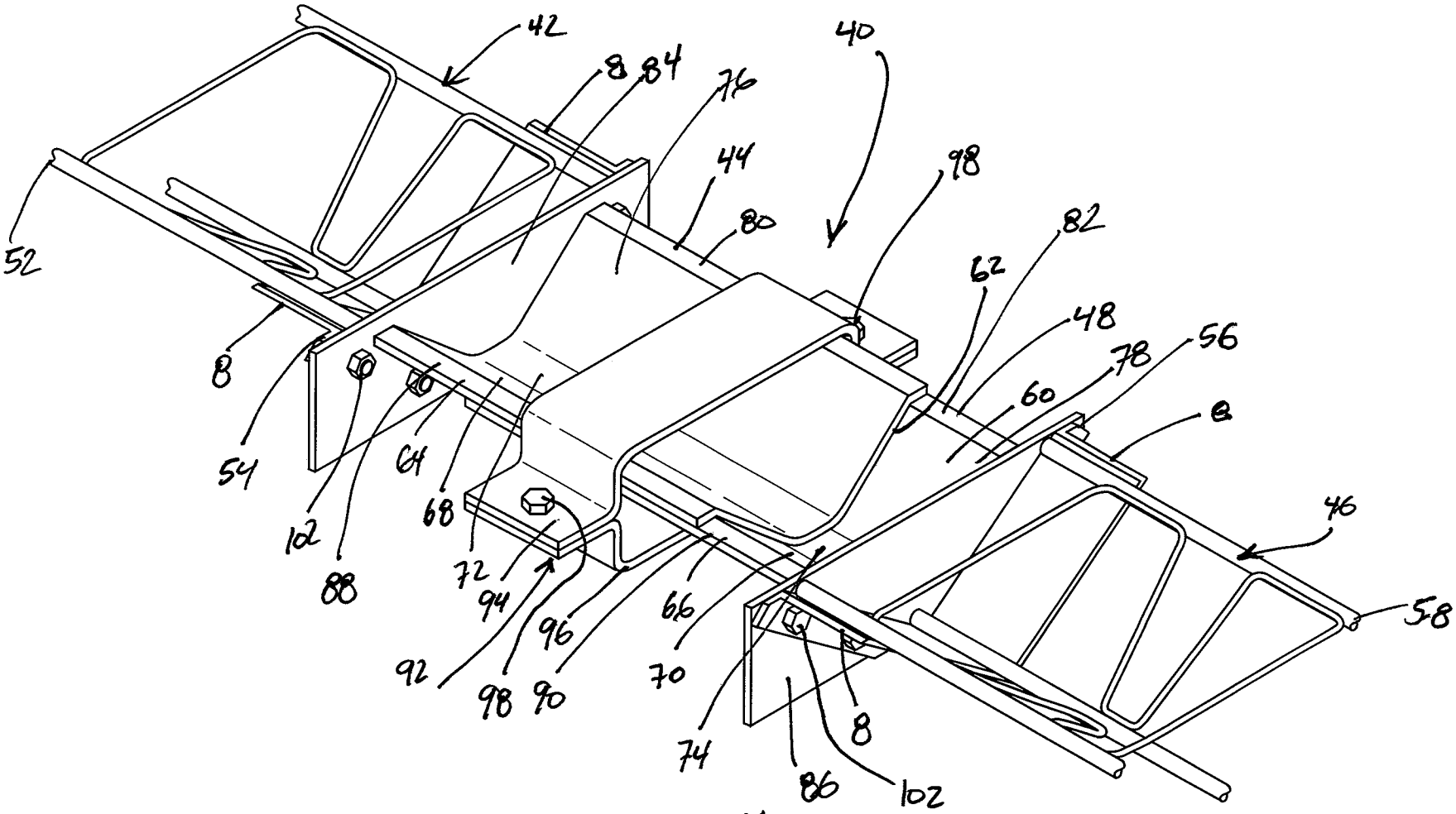
FIG. 4 is a partial perspective view of an adjustable lattice girder according to a third aspect of the present invention.
Figure 5:
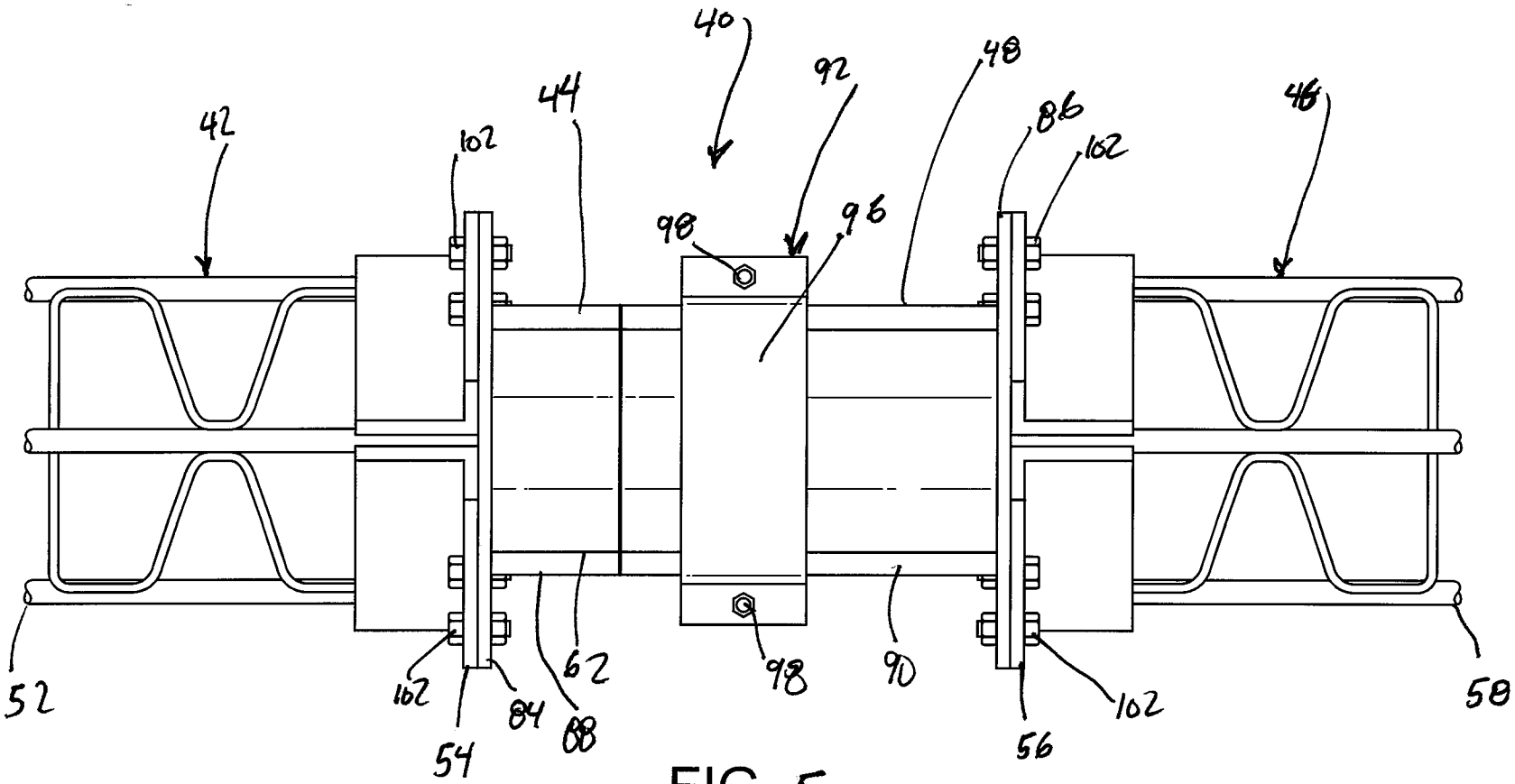
FIG. 5 is a partial top view of the adjustable lattice girder of FIG. 4.
Figure 6A:
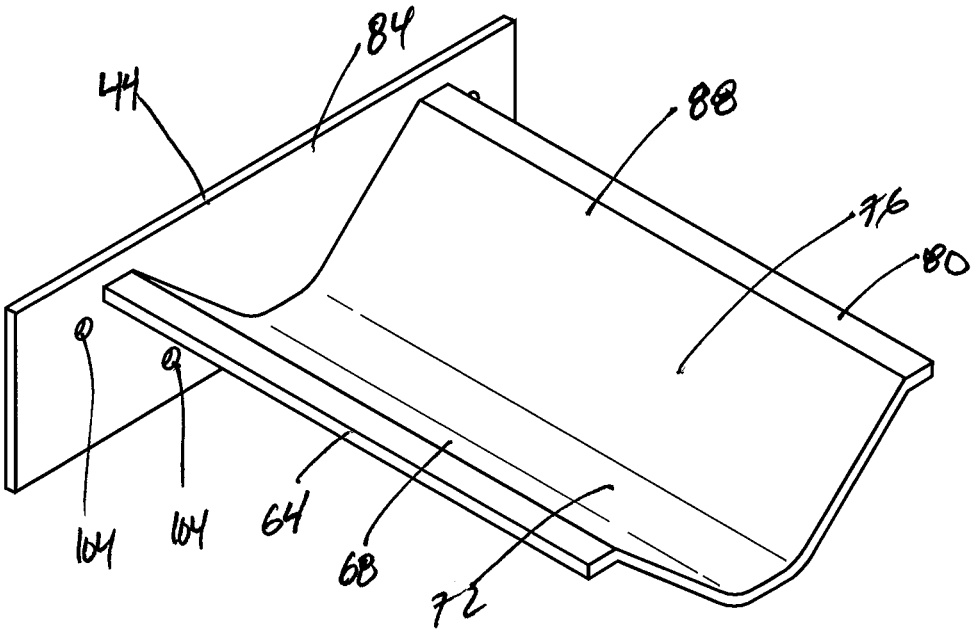
FIG. 6A is a perspective view of a connection member of the adjustable lattice girder of FIG. 4.
Figure 6B:
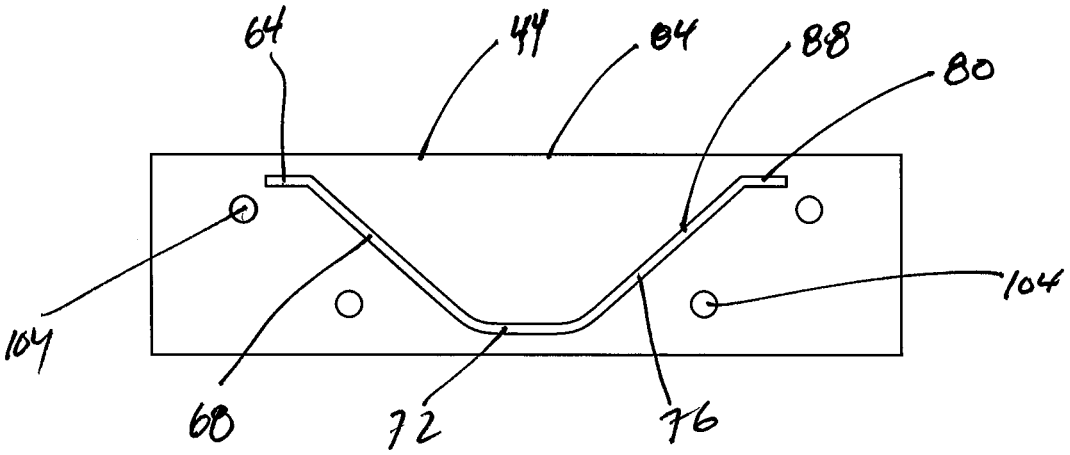
FIG. 6B is a front view of a connection member of the adjustable lattice girder of FIG. 4.
Figure 7:
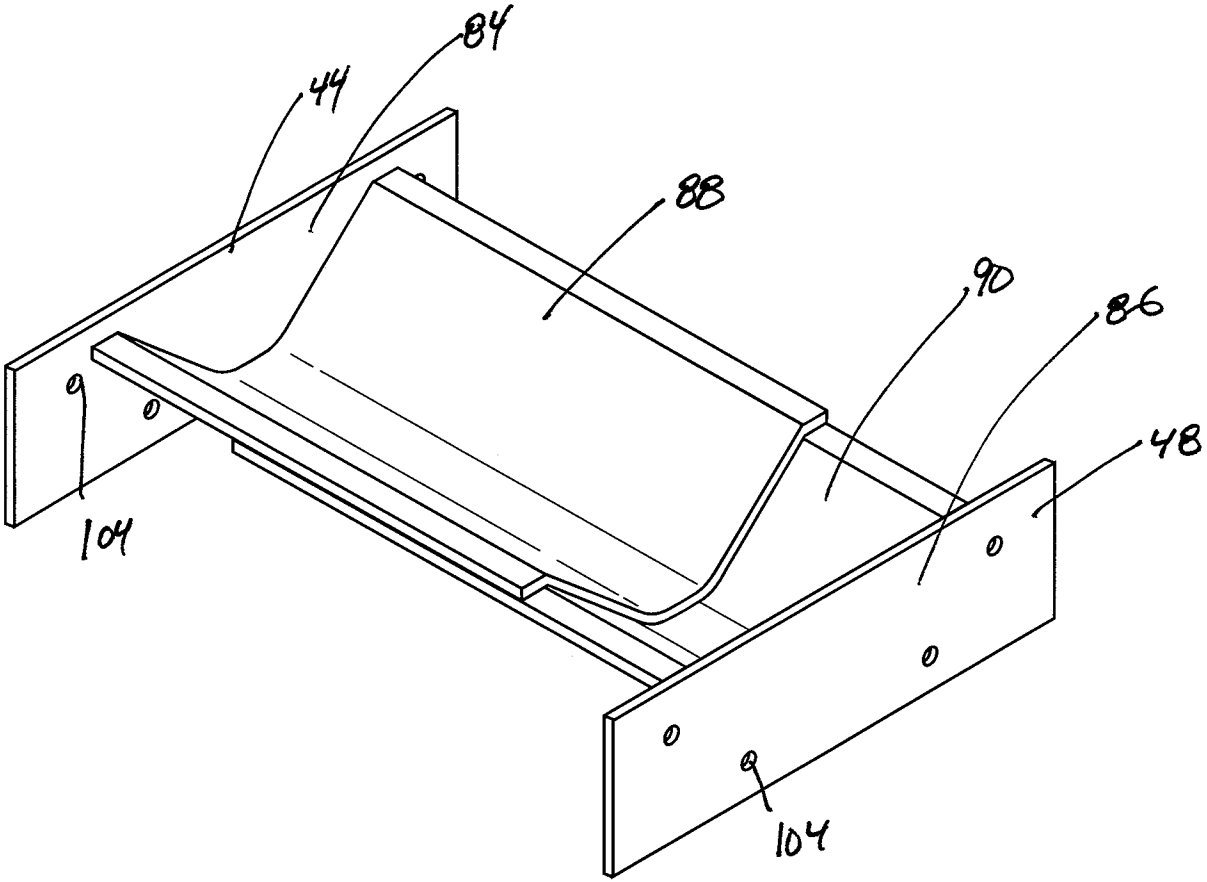
FIG. 7 is a perspective view of a connection of the adjustable lattice girder of FIG. 4.

Referring to FIGS. 4 and 5, the adjustable lattice girder 40 includes a lock mechanism 92 configured to lock the first and second connection members 44, 48 in one of the first and second positions. The lock mechanism 92 is a clamp in FIGS. 4 and 5, although other suitable arrangements may be utilized. The lock mechanism 92 includes a first clamp member 94 and second clamp member 96, with the lock mechanism 92 configured to receive an overlapping portion of the first and second connection members 44, 48 between the first clamp member 94 and the second clamp member 96. The first clamp member 94 is secured to the second clamp member 96 to prevent relative movement between the clamp members 94, 96 via one or more fasteners 98, such as a nut and bolt, although other suitable arrangements may be utilized.

The first and second lattice girder portions 42, 46 may be similar to the lattice girder portion 2 discussed above in connection with FIG. 1. The bases 84, 86 of the first and second connection members 44, 48 are each secured to the end plates 8 of the first and second lattice girder portions 42, 46 via fasteners 102 extending through apertures 104 defined by the bases 84, 86 of the first and second connection members 44, 48 and the apertures 14 of the end plates 8, such as nuts and bolts, although other suitable fastening arrangements may be utilized.

In one aspect or embodiment, the length of the adjustable lattice girder 40 can be changed by loosening or removing the lock mechanism 92, which allows the first and second connection members 44, 48 to slide between the first and second positions thereby changing the distance between the first and second lattice girder portions 42, 46. When a desired length of the adjustable lattice girder 40 is achieved, the lock mechanism 92 can be tightened to prevent relative movement between the first and second connection members 44, 48.

Referring to FIGS. 8-12, an adjustable lattice girder 110 according to a fourth aspect or embodiment of the present application is shown. The adjustable lattice girder 110 of FIGS. 8-12 is similar to the adjustable lattice girder 40 of FIGS. 4-7. The adjustable lattice girder 110 of FIGS. 8-12, however, is fully collapsible as discussed in more detail below.

Figure 11:
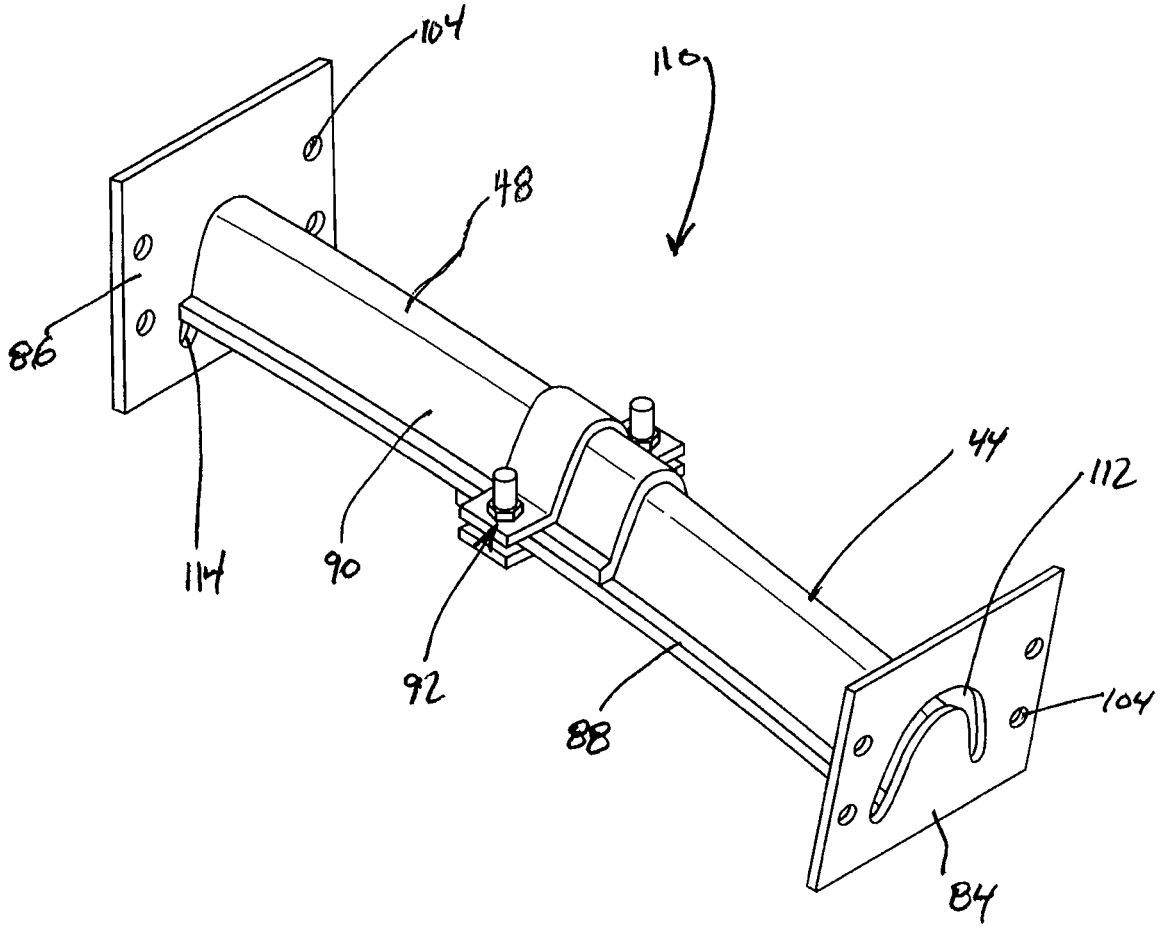
FIG. 11 is a perspective view of a connection of the adjustable lattice girder of FIG. 8.

Referring to FIG. 11, the base 84 of the first connection member 44 defines an opening 112 configured to receive at least a portion of the extension portion 90 of the second connection member 48. The base 86 of the second connection member 48 also defines an opening 114 configured to receive at least a portion of the extension portion 88 of the first connection member 44. The openings 112, 114 in the bases 84, 86 of the first and second connection members 44, 48 are V-shaped to accommodate the V-shaped profiles of the first and second connection members 44, 48, although other suitable shapes and configurations may be utilized.

Referring again to FIGS. 8-12, the bases 84, 86 of the first and second connection members 44, 48 are spaced from each other when the first and second connection members 44, 48 are in the first position (FIG. 9), and the bases 84, 86 of the first and second connection members 44, 48 are engaged with each other when the first and second connection members 44, 48 are in the second position (FIG. 8).

In order to facilitate the reception of the extension portions 88, 90 of the first and second connection members 44, 48, the openings 112, 114 in the bases 84, 86 of the first and second connection members 44, 48 are located either above or below the extension portions 88, 90. Because the extension portions 88, 90 of the first connection member 44 is overlaid on the extension portions 88, 90 of the second connection member 48, the opening 114 of the second connection member 48 will be positioned above the extension portion 90 of the second connection member 48. The opening 112 of the first connection member 44 will be located below the extension portion 88 of the first connection member 44 in order to receive the extension portion 90 of the second connection member 48. This configuration permits the extension portions 88, 90 of the first and second connection members 44, 48 to collapse within the opposing connection members 44, 48 and lattice girder portions 42, 46. The extension portions 88, 90 of the first and second connection members 44, 48 are shaped to fit within the rebar 4 and connecting rods 6 of the opposing lattice girder portion when collapsed.

Figure 8:
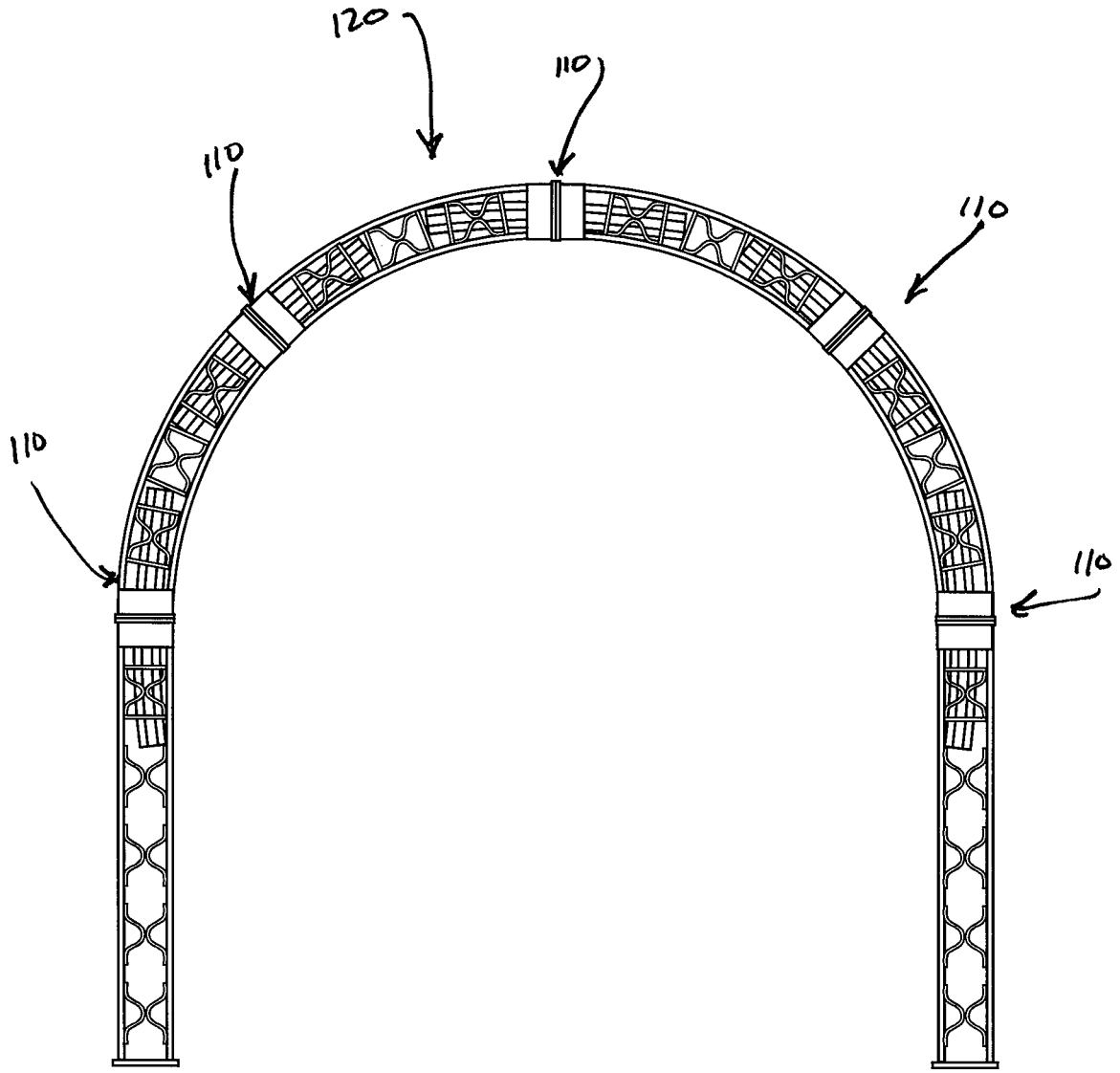
FIG. 8 is a side view of an adjustable lattice girder according to a further aspect of the present invention, showing a first position of a connection.
Figure 10:
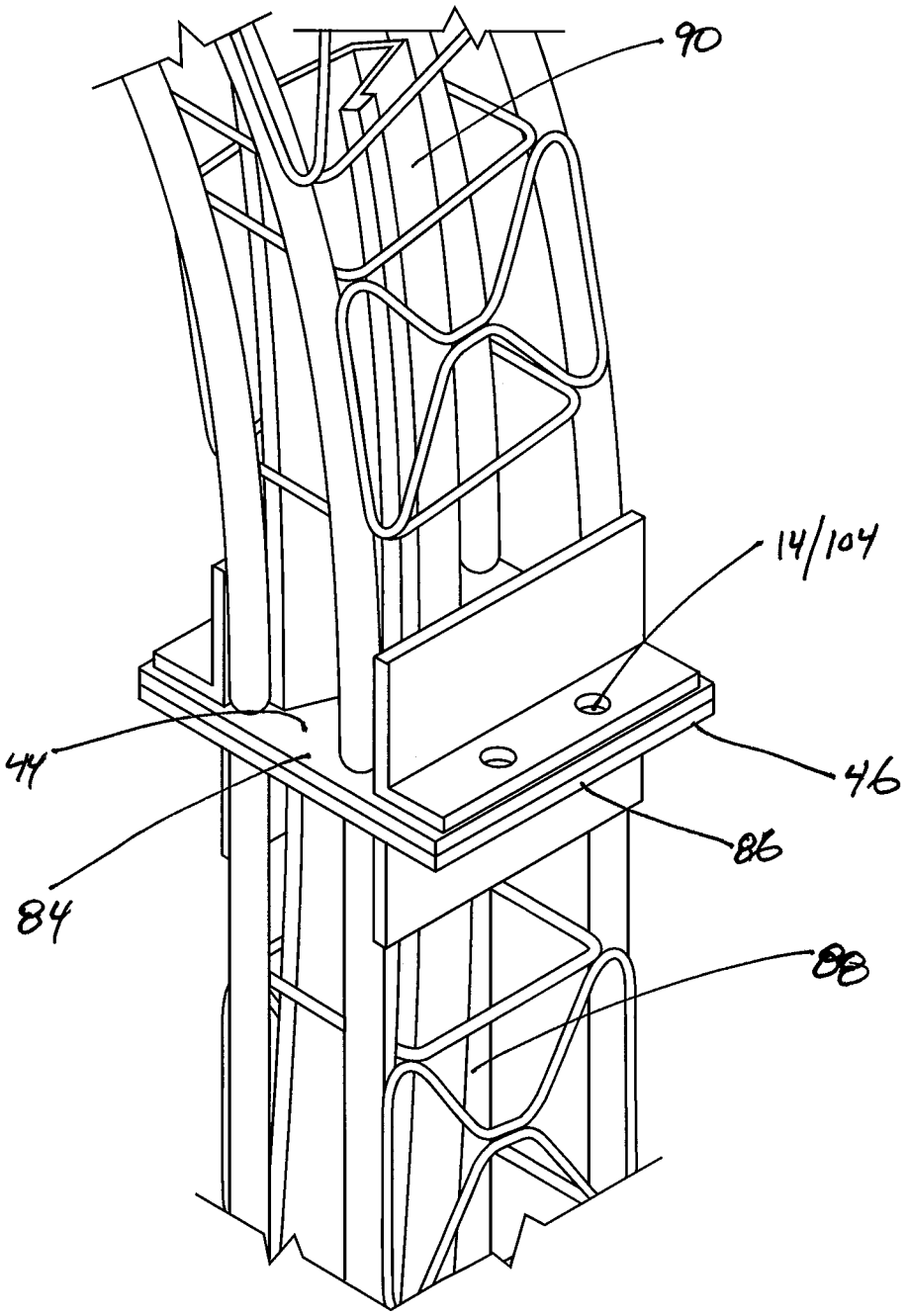
FIG. 10 is a partial perspective view of the adjustable lattice girder of FIG. 8.

When the adjustable lattice girder 110 is fully collapsed, the bases 84, 86 of the first and second connection members 44, 48 may abut one another, as shown in FIGS. 8 and 10. In order to fully collapse the adjustable lattice girder 110, the fasteners 102 may be removed permitting the apertures 14, 104 to align along a common axis. One or more fasteners 102 may be positioned through the aligned apertures 14, 104 to secure the first and second lattice girder portions 42, 46 in the fully collapsed position, although other suitable securing arrangements may be utilized.

Figure 9:
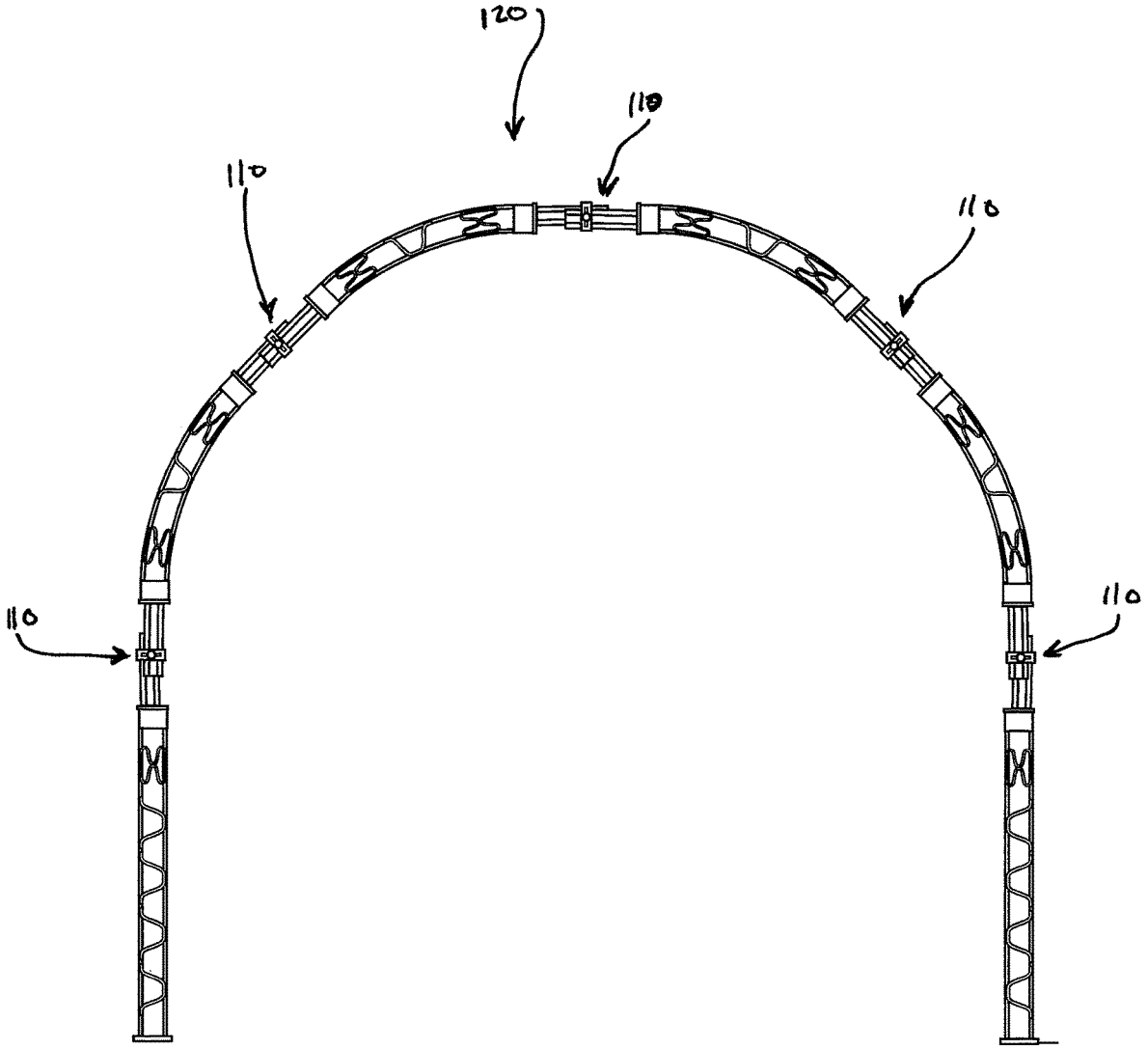
FIG. 9 is a side view of the adjustable lattice girder of FIG. 8, showing a second position of a connection.

Referring to FIGS. 8, 9, and 12, a lattice girder system 120 utilizing one or more adjustable lattice girders 15, 20, 40, 110 is shown. More specifically, the lattice girder system 120 includes five adjustable lattice girder portions 110 joined with respective first and second connection members 44, 48. The lattice girder portions 42, 46 may be formed with various shapes and configurations to achieve the desired overall shape of the lattice girder system 120, such as an arch. The lattice girder system 120 is shown with the first and second connection members 44, 48 in the first, collapsed position (FIG. 8) and with the first and second connection members 44, 48 in the second, expanded position (FIGS. 9 and 12). FIG. 12 shows the lattice girder system 120 abutting and supporting an excavation. The first and second connection members 44, 48 can each be adjusted to support the excavation. When the lattice girder system 120 is no longer needed to support the excavation, the first and second connection members 44, 48 can be collapsed for easier dismantlement, removal, and/or storage.

Although the invention has been described in detail for the purpose of illustration based on what is currently considered to be the most practical and preferred embodiments, it is to understood that such detail is solely for that purpose and that the invention is not limited to the disclosed embodiments but, on the contrary, is intended to cover modifications and equivalent arrangements that are within the spirit and scope of the appended claims. For example, it is to be understood that the present invention contemplates that, to the extent possible, one or more features of any aspect embodiment can be combined with one or more features of any other aspect or embodiment.

The invention claimed is:

1. An adjustable lattice girder comprising:

a first lattice girder portion comprising a first end and a second end positioned opposite the first end, the first lattice girder portion having a first connection member comprising a base defining a first opening and an extension portion extending from the base; and a second lattice girder portion comprising a first end and a second end positioned opposite the first end, the second lattice girder portion having a second connection member comprising a base defining a second opening and an extension portion extending from the base, the second connection member configured to engage the first connection member, the first connection member slidable relative to the second connection member between a first position corresponding to a first distance between the second end of the first lattice girder portion and the first end of the second lattice girder portion, and a second position corresponding to a second distance between the second end of the first lattice girder portion and the first end of the second lattice girder portion, the first distance is different than the second distance, wherein the first opening is configured to receive at least a portion of the extension portion of the second connection member and the second opening is configured to receive at least a portion of the first extension portion, and wherein the extension portion of the first connection member comprises a first profile and the extension portion of the second connection member comprises a second profile, and wherein one of the first profile and the second profile is configured to overlap and slide within the other of the first profile and the second profile.

2. The adjustable lattice girder of claim 1, wherein the first and second profiles are V-shaped.

3. The adjustable lattice girder of claim 2, wherein the first and second connection members each comprises a first flange, a first side portion extending from the first flange, a bottom portion extending from the first side portion, a second side portion extending from the bottom portion, and a second flange extending from the second side portion.

4. The adjustable lattice girder of claim 1, further comprising a lock mechanism configured to lock the first and second connection members in one of the first and second positions.

5. The adjustable lattice girder of claim 4, wherein the lock mechanism comprises a clamp.

6. The adjustable lattice girder of claim 5, wherein the clamp comprises a first clamp member and a second clamp member, the clamp configured to receive an overlapping portion of the first and second connection members between the first clamp member and the second clamp member.

7. The adjustable lattice girder of claim 1, wherein the bases of the first and second connection members are spaced from each other when the first and second connection members are in the first position, and wherein the bases of the first and second connection members are engaged with each other when the first and second connection members are in the second position.

8. A lattice girder system comprising:

a plurality of adjustable lattice girders, each adjustable lattice girder comprising:

a first lattice girder portion comprising a first end and a second end positioned opposite the first end, the first lattice girder portion having a first connection member comprising a base defining a first opening and an extension portion extending from the base; and a second lattice girder portion comprising a first end and a second end positioned opposite the first end, the second lattice girder portion having a second connection member comprising a base defining a second opening and an extension portion extending from the base, the second connection member configured to engage the first connection member, the first connection member slidable relative to the second connection member between a first position corresponding to a first distance between the second end of the first lattice girder portion and the first end of the second lattice girder portion, and a second position corresponding to a second distance between the second end of the first lattice girder portion and the first end of the second lattice girder portion, the first distance is different than the second distance, wherein the first opening is configured to receive at least a portion of the extension portion of the second connection member and the second opening is configured to receive at least a portion of the first extension portion, and wherein the extension portion of the first connection member comprises a first profile and the extension portion of the second connection member comprises a second profile, and wherein one of the first profile and the second profile is configured to overlap and slide within the other of the first profile and the second profile.

9. The lattice girder system of claim 8, wherein the lattice girder system is arch shaped.

10. The lattice girder system of claim 8, wherein the lattice girder system is configured to support an excavation.

* * * * *